US008251490B2

(12) United States Patent
Ciampini et al.

(10) Patent No.: US 8,251,490 B2
(45) Date of Patent: Aug. 28, 2012

(54) INK JET PRINTING HEAD

(75) Inventors: Davide Ciampini, Arnad (IT); Fulvio Cominetti, Arnad (IT); Luigina Gino, Arnad (IT); Pier Luigi Soriani, Arnad (IT)

(73) Assignee: Telecom Italia S.p.A., Milan (IT)

( * ) Notice: Subject to any disclaimer, the term of this patent is extended or adjusted under 35 U.S.C. 154(b) by 546 days.

(21) Appl. No.: 12/446,155

(22) PCT Filed: Oct. 17, 2006

(86) PCT No.: PCT/EP2006/010003

§ 371 (c)(1),
(2), (4) Date: Apr. 17, 2009

(87) PCT Pub. No.: WO2008/046434

PCT Pub. Date: Apr. 24, 2008

(65) Prior Publication Data

US 2010/0182375 A1 Jul. 22, 2010

(51) Int. Cl.
*B41J 2/14* (2006.01)
*B41J 2/16* (2006.01)

(52) U.S. Cl. ..... 347/45; 347/47; 347/71

(58) Field of Classification Search ..... 347/15, 347/40, 43–47, 65–71, 73, 77, 82
See application file for complete search history.

(56) References Cited

U.S. PATENT DOCUMENTS 5,136,310 A * 8/1992 Drews ..... 347/45
5,859,654 A 1/1999 Radke et al.
6,062,679 A 5/2000 Meyer et al.
6,659,596 B1 12/2003 Keefe et al.
6,942,318 B2 * 9/2005 Fartash ..... 347/44
7,048,359 B2 5/2006 Keefe et al.

FOREIGN PATENT DOCUMENTS

EP 0 906 828 4/1999

OTHER PUBLICATIONS

International Search Report for PCT/EP2006/010003 dated Oct. 5, 2007.

Europlasma Technical Paper, "Plasmapolymerisation: Pretreatment and finishing of polymer surfaces in the field of medical plastics," Europlasma, Oudenaarde (Belgium), Sep. 20, 2004.

Europlasma Technical Paper, "Functionalization of Polymer Surfaces," Introduction of functional groups at polymer surfaces by Glow discharge techniques, J.G.A. Terlingen, Chapter 2, Aug. 5, 2004.

* cited by examiner

*Primary Examiner* — Thinh Nguyen
(74) *Attorney, Agent, or Firm* — Venable LLP; Robert Kinberg; Leigh D. Thelen

(57) ABSTRACT

The present invention relates to an ink-jet print head comprising a substrate, a structural or barrier layer defining ink passage ways, and, optionally, a nozzle plate, wherein a layer of polymeric material comprising carbon, hydrogen, and nitrogen atoms improves the adhesion of the layer defining ink passage ways with the substrate and/or the nozzle plate. The present invention also relates to a process of manufacturing an inkjet print head including the step of forming the layer of polymeric material comprising carbon, hydrogen, and nitrogen atoms with a plasma treatment.

37 Claims, 3 Drawing Sheets

INK JET PRINTING HEAD

FIELD OF INVENTION

The present invention generally relates to a printhead for ink-jet printers and a manufacturing process thereof, and, more particularly, to a printhead comprising a substrate, a structural or barrier layer defining ink passage ways, and a nozzle plate having improved adhesion between the substrate and/or the nozzle plate and the structural or barrier layer.

BACKGROUND OF INVENTION

The art of ink-jet printing is nowadays relatively well developed. Commercial products such as computer printers, graphics plotters, and facsimile machines have been implemented with ink-jet technology for producing printed media.

Generally an ink-jet image is formed when a precise pattern of dots is ejected from a drop-generating device known as a "printhead" onto a printing medium, typically a paper sheet. Typically, an ink-jet printhead is supported on a movable carriage that traverses over the surface of the paper sheet and is controlled to eject drops of ink at appropriate times pursuant to commands of a microprocessor or other controller, wherein the timing of the application of the ink drops is intended to correspond to a pattern of pixels of the image being printed.

The ink jet print head of an ink jet printer generally comprises a substrate, a layer defining ink passage ways, usually named in the art as "barrier layer" and a nozzle plate. The substrate is generally made of silicon. A plurality of thin film layers is deposited on a face of the silicon substrate to make up the active electronic components, the ejection actuators, the conductive traces, and the protective elements. The ejection actuators are substantially of two kinds, thermal actuators and mechanical actuators. The thermal actuators provide the energy to eject the ink drop by means of the heat provided by a resistor which vaporize the ink contacting the resistor surface. The mechanical actuators provide the energy to eject the ink drop by means of the vibration of a lamina which mechanically ejects the ink. The substrate more particularly includes a top layer of tantalum having a protective and anti-cavitation action.

The barrier layer is generally made of a photopolymer. Using photolithographic techniques, the ejection chambers and the microidraulic channels which represent the passage ways for the ink delivery and storage are realized in the photopolymer barrier layer. The nozzle plate is generally made of a plastic material, such as, for example, polyimide, or a metallic material, such as, for example, palladium plated nickel, rhodium plated nickel, or gold plated nickel. The nozzle plate provided with ejection nozzles made in correspondence with the ejection resistors and the ejection chambers is attached to the barrier layer.

In recent years, the nozzle plate has been made integrally with the barrier layer. When the layer defining ink passage ways includes both the barrier layer and the nozzle plate, such a layer is known in the art as a "structural layer". In such a case, the manufacturing process includes a step of forming a pattern of the ejection chambers and the microidraulic channels with a soluble resin or a metal, a step of coating a photopolymer covering the soluble resin or metal pattern, a step of forming orifices in the photopolymer in correspondence of the ejection chambers over the ejection resistors, a step of curing the photopolymer, and a step of dissolving the soluble resin or metal.

A main concern related to the foregoing ink-jet printhead architecture includes delamination of the polymeric layer defining ink passage ways (i.e., the barrier or structural layer) from the substrate and/or from the nozzle plate. Delamination principally occurs due to the action of environmental moisture and ink which are in continuous contact with the edges of the interface between the polymeric layer and the substrate or the nozzle plate in the drop generator regions.

The adhesive characteristics of tantalum are due to the fact that such a metal is easily oxidized by the oxygen contained in the atmosphere. The tantalum oxide is able to form chemical bonds with the polymeric material of the barrier or structural layer. However, the chemical bond between tantalum oxide and a polymer film tends to be easily degraded by water, since the water forms a hydrogen bond with the oxide that competes with and replaces the original polymer to oxide bond, and thus ink formulations debond an interface between tantalum oxide and a polymer barrier.

In particular, a solvent, such as water, from the ink enters within the interface between the thin film substrate and the barrier layer and/or the interface between barrier layer and the nozzle plate, causing debonding of the interfaces through a chemical mechanism, such as hydrolysis, or a physical mechanism, such as swelling.

Moreover, new developments in ink chemistry have resulted in formulations containing additional components that more aggressively debond the interface between the thin film substrate and the barrier layer, as well as the interface between the barrier layer and the nozzle plate.

U.S. Pat. No. 6,659,596 and U.S. Pat. No. 7,048,359 disclose an ink jet printhead having a substrate comprising a plurality of thin film layers; a plurality of ink firing heater resistors defined in said plurality of thin film layers; a polymer barrier layer; and a carbon rich layer disposed on said plurality of thin film layers, for bonding said polymer barrier layer to said substrate. Both references disclose an improvement of the adhesion of the barrier layer to a tantalum layer.

Plasma processing is widely known processing technology that aims at modifying the chemical and physical properties of a surface by using a plasma-based material. Plasma processing includes plasma activation, plasma modification, plasma functionalization and plasma polymerization. Plasma processing is widely used in the field of electronics, automotive, textile, medical and aeronautic. A general review about plasma technology can be found on the Europlasma Technical Paper, "Functionalization of Polymer Surfaces", dated May 8, 2004 and "Plasmapolymerisation. Pretreatment and finishing of polymer surfaces in the field of medical plastics" dated 20/09/04. Both articles have been downloaded on Oct. 13, 2006 from the Europlasma Internet site at http://www.europlasma.be/pageview.aspx?id=181&mid=17.

SUMMARY OF THE INVENTION

The Applicant has noticed that the adhesion problem is worsened when using for the protective layer a noble metal like gold having a characteristic chemical inertness.

The problem of low adhesion to gold is even more difficult to solve in view of the peculiar inertness of a noble metal like gold. In fact, the resistance to oxidation of gold does not allow the formation of those polar groups (such as oxides or hydroxides) which, for instance, help the formation of bonds between tantalum layer and the photopolymer layer.

On the other hand, the protective action of a gold layer with respect to the underneath thin film layers made on the silicon substrate and the underneath metal of the nozzle plate has been found to be very good when compared to any other material, and in recent years the use of gold for this protective action has become more and more widespread.

Thus, an ink-jet printhead with an improved adhesion between a gold protective layer and the polymeric material of the barrier or structural layer would be advantageous and is desired in the art.

The Applicant has found that the formation of a layer of polymeric material comprising carbon, hydrogen, and nitrogen atoms on a gold layer increases the adhesion of the layer defining ink passage ways to the gold layer. Such a layer is advantageously made by plasma polymerization.

The Applicant has also found that such a layer of polymeric material comprising carbon, hydrogen, and nitrogen atoms can also improve the adhesion of the layer defining ink passage ways to any metal layer typically employed in the manufacturing of the nozzle plate and the thin film layers of the substrate, such as, for example, tantalum, nickel, copper, rhodium, aluminum and mixture thereof.

Accordingly, the present invention relates to an ink-jet print head comprising a substrate, a plurality of thin film layers and a layer defining ink passage ways, wherein said plurality of thin film layers comprises a metal layer facing said layer defining ink passage ways, characterized in that a layer of polymeric material comprising carbon, hydrogen, and nitrogen atoms is interposed between said metal layer and said layer defining ink passage ways.

The present invention also relates to an ink-jet print head comprising a substrate, a plurality of thin film layers, a barrier layer, and a nozzle plate wherein said nozzle plate comprises a metal layer facing said barrier layer, characterized in that a layer of polymeric material comprising carbon, hydrogen, and nitrogen atoms is interposed between said metal layer and said barrier layer.

The present invention also relates to a process of manufacturing an inkjet print head comprising the steps of providing a substrate, forming a layer of polymeric material comprising carbon, hydrogen, and nitrogen atoms on said substrate, and forming a layer defining ink passage ways on said polymeric material layer, wherein said step of forming a layer of polymeric material is made by plasma polymerization treatment of a surface of said substrate with a mixture of gases comprising carbon, hydrogen and nitrogen atoms.

The present invention also relates to a process of manufacturing an inkjet print head comprising the steps of providing a substrate, forming a layer defining ink passage ways on said substrate, providing a nozzle plate, forming a layer of polymeric material comprising carbon, hydrogen, and nitrogen atoms on a surface of said nozzle plate, and adhering said surface of said nozzle plate bearing said layer of polymeric material comprising carbon, hydrogen, and nitrogen atoms to said layer defining ink passage ways, wherein said step of forming a layer of polymeric material is made by plasma polymerization treatment of said surface of said nozzle plate with a mixture of gases comprising carbon, hydrogen and nitrogen atoms.

The Applicant has found that the layer of polymeric material comprising carbon, hydrogen, and nitrogen atoms increases the adhesion of the structural or barrier layer to the metal layer, and consequently to the substrate and/or to the nozzle plate.

The Applicant has also found that the layer of polymeric material comprising carbon, hydrogen, and nitrogen atoms increases the resistance to the delamination of the structural or barrier layer from the metal layer due to the action of ink contacting the edges of the interface.

The Applicant has also found that advantageously the layer of polymeric material comprising carbon, hydrogen, and nitrogen atoms can be formed substantially on the whole surface of the substrate without negatively interfering with the functionality of the printhead components, such as, actuators and/or openings for feeding ink. This allows an easier manufacturing process avoiding the use of protective layers during the plasma treatment and their subsequent removal.

BRIEF DESCRIPTION OF THE DRAWINGS

In order to understand the invention and to see how it may be carried out in practice, a preferred embodiment will now be described, by way of non-limiting example only, with reference to the accompanying drawings; in which.

DETAILED DESCRIPTION OF THE INVENTION

Figure 1:
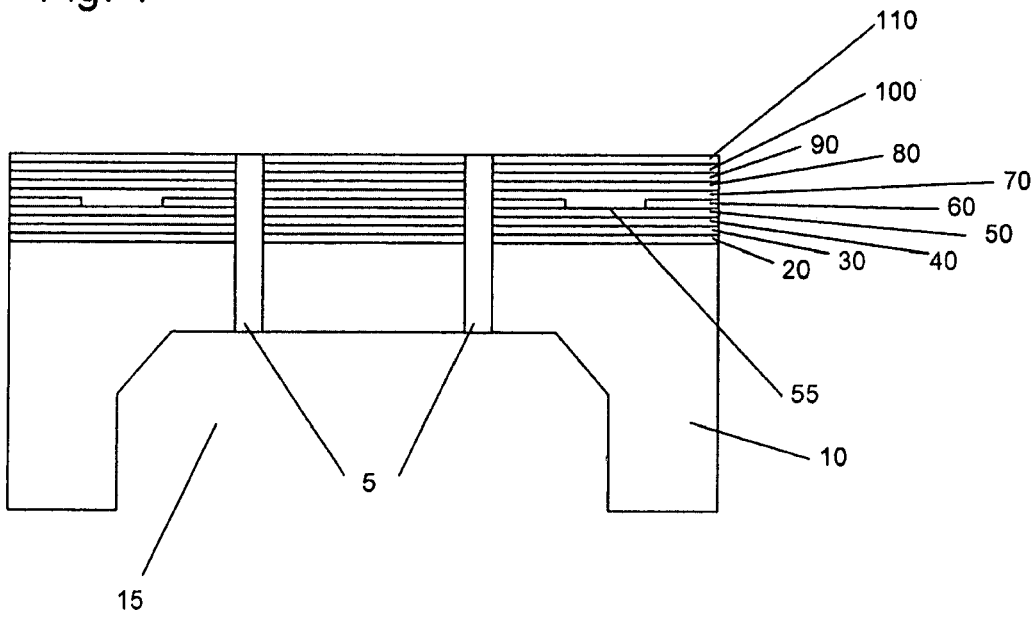
FIG. 1 shows a schematic section view of a substrate comprising thin film layers making up the active electronic components, the ejection resistors, the conductive traces, and the protective elements.

The substrate of the ink-jet printhead may be of any shape or any material as long as it can function as a part of the liquid flow path constituting member and as a support for the material layers that form the ink flow path and ink ejection nozzles to be described later. The substrate can be made from glass, metal, plastic, ceramic, or silicon.

On the upper surface of the substrate a plurality of thin film layers is formed to make up the active electronic components, the ejection resistors, the conductive traces, and the protective elements.

According to a preferred embodiment, the substrate will typically include a silicon substrate on which is deposited a thin layer of silicon dioxide for passivating and insulating the surface of the silicon substrate. Conventional semiconductor processes for manufacturing integrated circuits are employed to make the active electronic components. A plurality of heater resistors are formed on the upper surface of the silicon dioxide layer and will typically be either tantalum aluminum or tantalum pentoxide and fabricated using known photolithographic masking and etching techniques. Metal trace conductors make electrical contact to the heater resistors for providing electrical pulses thereto during an ink jet printing operation, and these conductors are formed from a layer of metal previously evaporated on the upper surface of the silicon layer using conventional metal evaporation or sputtering processes. Aluminum or copper or a mixture thereof are usually employed as the metal for trace conductors.

After the formation of the metal conductors and heater resistors is completed, a protective layer, typically of silicon carbide and silicon nitride, and an anti-cavitation layer, typically made of tantalum, are deposited over the upper surfaces of the conductors and the heater resistors to protect these members from cavitation wear due to ejection of ink bubbles and ink corrosion which would otherwise be caused by the highly corrosive ink located in the ejection chambers directly above these heater resistors. The protective and anti-cavitation layers, as well as the previously identified $SiO_2$ surface layer, resistors and aluminum conductors are, all formed using semiconductor processes well known to those skilled in thermal ink jet and semiconductor processing arts.

In order to further increase the resistance to corrosion of the metal conductors and heater resistors, a layer of gold is finally deposited on the tantalum anti-cavitation layer. The gold layer is patterned so as to form the top surface of the plurality of thin film layers in a region located generally in the middle of the substrate between the resistor regions and extending between the ends of the substrate. Bonding pads for external connections are formed in the gold layer, for example adjacent the ends of the substrate. Other metals, such as tantalum, aluminum, or copper can constitute the top surface of the thin film layers formed on the surface of the substrate in the region not covered by the patterned gold layer.

FIG. 1 is a schematic representation of a preferred embodiment of the substrate 10 employed to manufacture the ink-jet print head according to the present invention. FIG. 1 exemplifies a form in which openings 5 for feeding ink are provided in the substrate 10, and ink is fed from an ink reservoir (not shown) connected to the groove 15 communicating with said openings 5. In forming the openings, any means can be used so long as it is capable of forming a hole in the substrate. For instance, mechanical means such as a drill, or a light energy such as laser may be employed. Alternatively, it is permissible to use photolithographic technique's by applying a photoresist pattern or the like on the substrate, and chemically wet or dry etch it.

The foregoing substrate 10 was readily produced pursuant to standard thin film integrated circuit processing including chemical vapor deposition, photoresist deposition, masking, developing, and etching.

By way of illustrative example, the foregoing plurality of thin film layers was made as follows. Starting with the silicon substrate 10, any active region where transistors were to be formed were protected by patterned silicon oxide layers 20. Next, gate oxide was grown in the active regions, and a polysilicon layer 30 was deposited over the entire substrate. The gate oxide and the polysilicon were etched to form polysilicon gates over the active areas. The resulting thin film layers were subjected to phosphorous predeposition by which phosphorous was introduced into the unprotected areas of the silicon substrate. A BPSG layer 40 (Boron Phosphorous Silicon Glass, i.e., boron and phosphorous doped silicon oxide) was then deposited over the previously entire in-process thin film layers, and the boron and phosphorous doped silicon oxide coated layers were subjected to a diffusion drive-in step to achieve the desired depth of diffusion in the active areas. The BPSG layer 40 was then masked and etched to open contacts to the active devices.

The tantalum aluminum resistive layer 50 was then deposited, and the aluminum copper metallization layer 60 was subsequently deposited on the tantalum aluminum layer 50. The aluminum copper layer 60 and the tantalum aluminum layer 50 were dry etched together to form the desired conductive pattern. The resulting patterned aluminum copper layer 60 was then wet etched to open the resistor areas 55.

The silicon nitride ($Si_3N_4$) passivation layer 70 and the silicon carbide (SiC) passivation layer 80 were respectively deposited on the metal and resistor layers 50, 60. A photoresist pattern which defines vias to be formed in the silicon nitride and silicon carbide layers 70, 80 was disposed on the silicon carbide layer 80, and the thin film layers were subjected to dry etching, which opened vias through the composite passivation layer comprised of silicon nitride and silicon carbide to the aluminum copper metallization layer.

Figure 5:
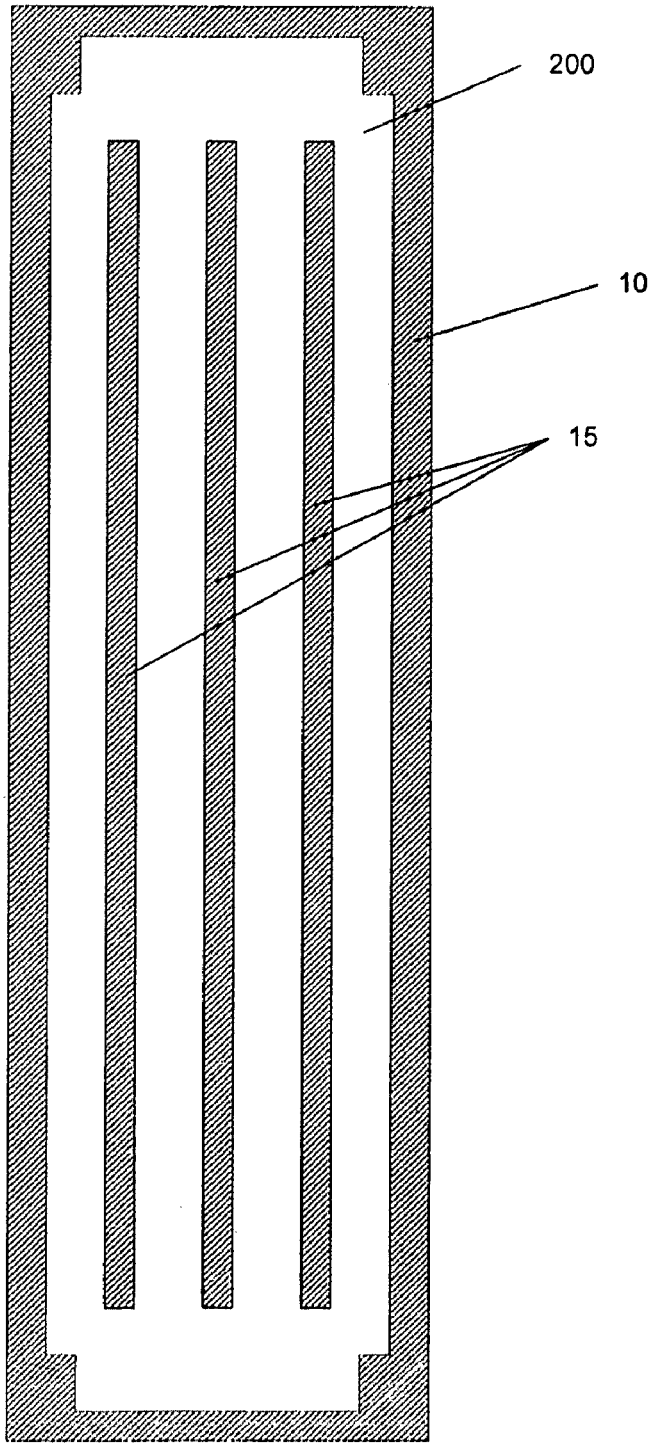
FIG. 5 shows a schematic plant view of the substrate of FIG. 1 (for sake of simplicity the openings 5 of FIG. 1 are omitted).

Finally, the tantalum layer 90 was deposited, with the gold metallization layer 100 subsequently deposited thereon. The gold layer 100 and the tantalum layer 90 were etched together to form the desired conductive pattern. The white area 200 of FIG. 5 schematically represents the area covered by the above described thin film layers 20 to 100, and then represents the area covered by gold which will by subjected to the plasma treatment of the present invention.

Referring back to FIG. 1, the silicon substrate 10 comprising the above described plurality of thin film layers 20 to 100 was then subjected to a plasma polymerization treatment to form the layer 110 of polymeric material comprising carbon, hydrogen, and nitrogen atoms.

The plasma treatment is performed by flowing a plasma gas on the substrate 10 in an apparatus comprising a plasma chamber powered with a couple of electrodes.

The plasma gas can include a carrier gas, such as argon, and a reagent gas. The reagent gas can be any suitable source for the desired composition of the coating. Typically, the reagent gas is a source for carbon, hydrogen, and nitrogen atoms. The reagent gas is preferably selected from the group consisting of saturated and unsaturated hydrocarbons, nitrogen-containing hydrocarbons, nitrogen, ammonia, carbon dioxide, and hydrogen. Saturated hydrocarbons, such as, for example, methane and ethane, and forming gas, a mixture of nitrogen and hydrogen with a 10% maximum content of hydrogen, are preferably used in the process of the present invention. More preferably, the forming gas useful in the process of the present invention comprises a mixture of 95% of nitrogen and 5% of hydrogen. Preferably, the mixture of methane and forming gas has a methane to forming gas weight ratio of from 1:5 to 5:1, more preferably from 1:3 to 3:1 and most preferably from 1:2 to 2:1.

The plasma apparatus typically includes a chamber containing positive and ground electrodes attached to a radio frequency (RF) generator. The chamber comprises a support which is positioned between the positive and ground electrodes. The support is properly isolated from the chamber walls. The substrate is preferably put on the support between the positive and ground electrodes. Alternatively, the substrate can also be put in contact with the positive electrode or the ground electrode. In operation, a vacuum is created within the chamber until a pre-selected pressure in the range of from 1 to 30 milliTorr, preferably from 5 to 20 milliTorr is reached.

The reagent gas is usually introduced into the chamber for a time of from 15 seconds to 3 minutes until to achieve the desired flow rate and partial pressures. The flow rate is preferably comprised from 1 to 300 sccm, more preferably form 10 to 200 sccm, and most preferably from 50 to 150 sccm. The partial pressures is preferably comprised from 10 to 500 milliTorr, more preferably from 30 to 300 milliTorr, and most preferably from 50 to 200 milliTorr.

Once the flow rate and pressure in the chamber are stabilised, a high voltage is applied in the radio frequency range of the apparatus between the ground and the positive electrodes and is maintained for the time required to allow for deposition of the polymeric film on the substrate. The radio frequency power is preferably in the range of from 10 to 400 Watt, more preferably from 20 to 200 Watt, and most preferably from 50 to 150 Watt. Preferably, the plasma treatment is conducted for a period of time in the range of from 15 seconds to 100 minutes, more preferably from 1 minute to 60 minutes, and most preferably from 5 minutes to 30 minutes.

The plasma treatment can be conducted under constant conditions, i.e., without modifying the above described values of gas flow rate, gas mixture, pressure, and power, or under variable conditions, depending on the specific polimeric composition of the structural or barrier layer to be adhered to the gold layer. The Applicant has found that by varying the gas flow rate and the gas mixture during the treatment, the adhesion can be improved and tailored for several polymeric compositions.

After completion of the deposition, the power is turned off and the reagent gas is still introduced for a time of from 15 seconds to 3 minutes before to stop the flux of gas and to evacuate the chamber until to reach a pressure in the range of from 1 to 30 milliTorr. In this manner, the possible residual reactivity of the surface is reduced to zero in the presence of the reagent gas, so as to avoid any possible side reaction with other gases. The chamber is then vented with fresh air and the substrate with the deposited polymeric film layer 110 is removed from the chamber.

The polymeric film layer 110 obtained with the process described above has a thickness of from 1 to 400 nm, preferably from 5 to 200 nm, and most preferably from 10 to 100 nm. The XPS analysis of the polymeric film layer 110 showed the presence of carbon, hydrogen and nitrogen atoms within the structure of the polymeric material. The polymeric film layer 110 comprises from 25 to 75, preferably from 35 to 65% by weight of carbon atoms, from 1 to 50, preferably from 5 to 40% by weight of nitrogen atoms, the remaining percentage being represented by hydrogen atoms linked either to the carbon or the nitrogen atoms.

While the inventor does not wish to be bound by any theory, and the invention should not be limited by such theory, it is believed that the polymeric film layer 110 formed with the plasma treatment of the present invention comprises saturated and insaturated hydrocarbons with amino groups, nitro groups and/or hydroxy groups linked to the main hydrocarbon chain. The amino groups, nitro groups and/or hydroxy groups are able to link covalently and/or electrostatically with the composition of a layer defining ink passage ways formed on the polymeric film layer 110 and accordingly, are believed to be responsible of the improved adhesion.

According to a preferred embodiment of the present invention, the polymeric film layer 110 is further treated with an adhesion promoting agent.

Adhesion promoters known to those skilled in the art may be used, such as, for example, epoxy alkoxy silanes, amino alkoxy silanes, vinyl alkoxy silanes, isocyanato alkoxy silanes, mercapto-silanes and amino-silanes.

More preferred adhesion promoter include γ-glycidoxypropyltrimethoxy silane, γ-aminopropyltrimethoxy silane, γ-isocyanatopropyltrimethoxy silane, N-β-(aminoethyl)-γ-aminopropyltrimethoxy silane, N-(2-aminoethyl)-3-aminopropylmethyldimethoxy silane, 3-aminopropylmethyldimethoxy silane, bis-(γ-trimethoxysilylpropylamine), N-phenyl-γ-aminopropyltrimethoxysilane, γ-iso-cyanatopropylmethyldimethoxy silane, γ-isocyanatopropyltriethoxy silane, β-(3,4-epoxycyclohexyl)ethyltriethoxy silane, γ-glycidoxypropylmethyldimethoxy silane, tris(γ-trimethoxysilylpropyl) isocyanurate, 2-(diphenylphosphino)-ethyl-triethoxysilane, trimethylsilylacetamide, bis[3-(triethoxysilyl) propyl]-tetra-sulphide, 3-mercaptopropyltriethoxy silane, vinyltriethoxy silane, and vinyltrimethoxy silane.

The treatment of the polymeric film layer 110 with the adhesion promoting agent can be preferably done by dissolving the adhesion promoting agent in a proper solvent and by dipping the adhesion promoting agent in the resulting solution or by spraying the resulting solution on the polymeric film layer 110. The treatment can last for a period of time of from 10 minutes to 24 hours, preferably from 20 minutes to 6 hours, and most preferably from 30 minutes to 3 hours. After the treatment, the substrate is washed and heated to remove the solvent. The heating also completes the reaction between the silane and the polymer. The choice of the solvent is not particularly limited. Any organic solvent able to dissolve the adhesion promoting agent can be used. Useful organic solvents can be selected from the group comprising hydrocarbons, such as benzene, toluene, xilene, and the like, alcohols, such as ethanol, methanol and the like, ketones, such as acetone, 2-pyrrolidone, N-methyl-2-pyrrolidone, N-vinyl-2-pyrrolidone, amides, such as formamide, N,N-dimethylformamide, N,N-dimethylacetamide, and ethers, such as diethyl ether, dioxane, tetrahydrofurage, dimethyl glycol ether.

The treatment of the polymeric film layer 110 with the adhesion promoting agent promotes the formation of at least one monolayer, i.e., a one-molecule thick layer, of the adhesion promoting agent on the surface of the polymeric film layer 110. By increasing the treatment time, two or more monolayers are formed on the surface of the polymeric film layer 110.

While the inventor does not wish to be bound by any theory, and the invention should not be limited by such theory, it is believed that the adhesion promoting agent is able to react with the nucleofilic groups of the polymeric film layer 110 and then to react with the composition of a layer defining ink passage ways formed on the polymeric film layer 110, so increasing the number and the strength of links between the polymeric film layer 110 and such a layer defining ink passage ways.

After forming the polymeric film layer 110, and optionally, after the above described treatment with adhesion promoting, agents, a layer defining ink passage ways was formed using standard photolithographic manufacturing techniques. The layer defining ink passage ways was preferably formed from a photosensitive resin composition dissolved in a proper solvent. The layer defining ink passage ways can be a structural layer or a barrier layer.

Figure 2:
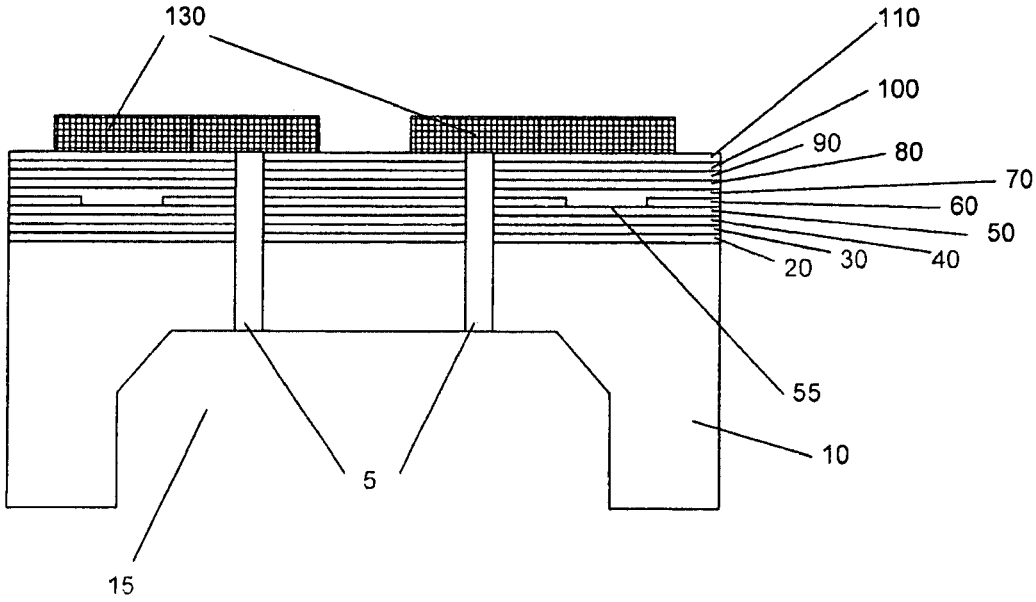
FIG. 2 shows a schematic section view of a semifinished ink jet printhead.
Figure 3:
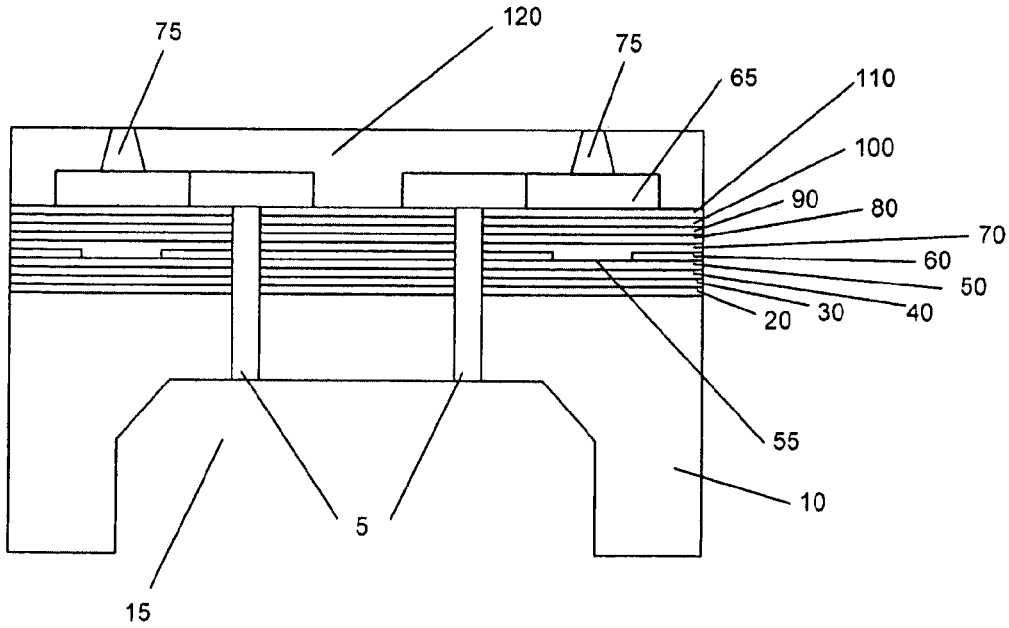
FIG. 3 shows a schematic section view of a ink jet printhead comprising a substrate and a structural layer.

FIG. 3 shows an embodiment of the present invention wherein the layer defining ink passage ways is a structural layer 120 which defines ejecting chambers 65 and nozzles 75. Before applying the photosensitive resin composition, a pattern 130, as shown in FIG. 2, defining the shape of the ink passage ways was formed on the substrate. The pattern 130 can be made by any material which can be subsequently removed after the application of the photosensitive resin composition and formation of the structural layer 120. The most common process employed for forming the pattern 130 is a photolithographic process using a second photosensitive material, different from that of the structural layer 120, usually a dissoluble resin, but other processes such as screen printing or galvanic metal deposition can be employed. After formation of the pattern 130, the photosensitive resin composition can be applied on the upper surface of the substrate, i.e., the surface comprising the top gold layer 100 and the polymeric film layer 110, by using any method know in the art, such as, for example, spin coating or spray coating. A preferred method for applying the composition to the substrate involves centering the substrate on an appropriate sized chuck of either a resist spinner or conventional wafer resist deposition track. The composition is either dispensed by hand or mechanically into the center of the substrate. The chuck holding the substrate is then rotated at a predetermined number of revolutions per minute to evenly spread the composition from the center of the substrate to the edge of the substrate. After the application, the solvent is evaporated by heating the coated substrate, optionally under low pressure conditions.

After that, a pattern of ejection nozzles 75 is made in the structural layer 120 in correspondence with the ejection resistors 55 and the ejection chambers 65 by using techniques well known in the art such as, for example, photolithographic, plasma etching, chemical dry etching, reactive ion etching, or laser etching techniques. The dissoluble resin (or any other removable material) forming the pattern 130 of the ink passage ways is finally removed. The dissolution of the resin is easily performed by dipping the substrate in the solvent or spraying the solvent on the substrate. Joint use of ultrasonic waves can shorten the duration of dissolution.

Figure 4:
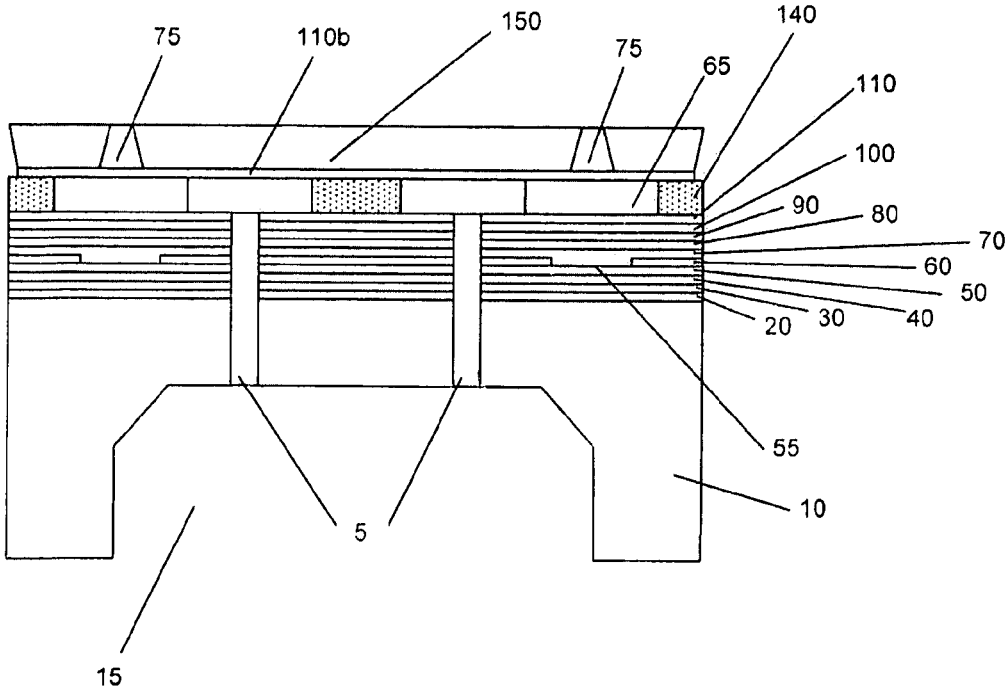
FIG. 4 shows a schematic section view of a ink jet printhead comprising a substrate, a barrier layer, and a nozzle plate.

FIG. 4 shows another embodiment of the present invention wherein the layer defining ink passage ways is a barrier layer 140 which defines the ejection chambers 65. A nozzle plate 150, which defines the nozzles 75 is attached to the barrier layer 140. The manufacturing process of this embodiment does not require the use of the above described pattern 130. The photosensitive resin composition can be directly applied on the upper surface of the substrate, i.e., the surface comprising the top gold layer 100 and the polymeric film layer 110, by using any method know in the art, such as, for example, spin coating or spray coating as described above. Similarly to what described above, the photosensitive resin composition can be masked, exposed to a collimated ultraviolet light source, baked after exposure and developed to define the ink passage ways by removing unneeded material. The mask is a clear, flat substrate usually glass or quartz with opaque areas defining the pattern to be removed from the coated film. After completing the definition of the ink passage ways, a nozzle plate 150 is secured to the barrier layer 140 with ejection nozzles 75 made in correspondence with the ejection resistors 55 and the ejection chambers 65.

The nozzle plate 150 is generally made of a metallic material, such as, for example, palladium plated nickel, rhodium plated nickel, or gold plated nickel.

According to another aspect of the present invention, the nozzle plate 150 was subjected to a plasma polymerization treatment to form the layer 110*b* of polymeric material comprising carbon, hydrogen, and nitrogen atoms on the surface intended to face the barrier layer in the finished ink-jet print head prior to secure the nozzle plate 150 to the barrier layer 140. The plasma polymerization treatment of the nozzle plate 150 is conducted with the same ingredients and under the same conditions as described above for the plasma polymerization treatment of the substrate. The resulting polymeric film layer 110*b* has the same characteristics of the polymeric film layer 110 described above and can be optionally be subjected to the same treatment with an adhesion promoting agent. The surface of the nozzle plate 150 opposite to the treated surface is preferably protected from the plasma action with a protective layer, such as, for example, an adhesive tape or a photoresist layer.

After the plasma polymerization treatment, the nozzle plate 150 is secured to the barrier layer 140 so that the nozzles 75 are in precise alignment with the ink ejectors 55 on the substrate 10 and the ejection chambers 65 of the barrier layer 140. This is accomplished by placing the bottom surface of the nozzle plate 150 against and in physical contact with the upper face of the barrier layer 140. Specifically, the bottom surface of the nozzle plate 150, i.e., the surface bearing the polymeric film layer 110*b*, is urged toward and against the upper surface of the barrier layer 140. Preferably, the nozzle plate 150 and the barrier layer 140 are joined by thermocompression bonding method, which comprises the application of a pressure at relatively high temperature. For example, during physical engagement between the nozzle plate 150 and the barrier layer 140, both of these components are subjected (e.g. heated) to a temperature of about 160-250° C., with pressure levels of about 75-250 psi being exerted on such components. A conventional heated pressure-exerting platen apparatus may be employed for this purpose. The exact temperature and pressure levels to be selected in a given situation may be determined in accordance with routine preliminary testing taking into consideration the particular materials being used, in connection with the barrier layer and the nozzle plate.

The invention will be now described with reference to the following non-limiting example.

EXAMPLE 1

Three samples were prepared according to the following procedure. The silicon substrate 10 comprising the thin film layers 20 to 100 was inserted into a Europlasma Surface Treatment CD400PC System, manufactured by Europlasma NV, Belgium, an apparatus comprising an aluminium chamber containing positive and ground electrodes attached to a Radio Frequency (RF) generator operating at 13.56 MHz.

A gas inlet valve was then opened and the reagent gas at a metered rate was introduced into the chamber for a time of from 15 seconds to 3 minutes until to achieve the desired flow rate and partial pressures. Once the flow rate and pressure in the chamber were stabilised, a high voltage was applied in the radio frequency range between the ground and the positive electrodes and was maintained for the time required to allow for deposition of the polymeric film on the substrate.

The reagent gas was methane and the partial pressure, the RF power, the gas flux rate, and the deposition times were summarized in the following Table 1.

TABLE 1

| Sample | Pressure (mT) | Power (W) | Flux (sccm) | Time (min) |
|---|---|---|---|---|
| 1 (C) | 150 | 100 | 135 | 10 |
| 2 (C) | 150 | 200 | 135 | 10 |
| 3 (C) | 150 | 300 | 135 | 10 |

(C) Comparative example

The adhesion properties of the polymeric film were tested by placing the samples in a conventional aqueous ink at 65° C. for three weeks and then observing the samples with an optical microscope. The polymeric film of samples 1 and 2 remained well adhered to the substrate without showing any trace of detachment or seepage. On the contrary, the polymeric film of sample 3 was partially detached and showed several seepages of ink beneath it.

A radiation curable composition having the formula of Table 2 was spun coated on samples 1 and 2 by means of a OPTispin ST20 spinner manufactured by SSE Sister Semiconductor Equipment Gmbh at 2,000 rpm for 15 seconds to provide a 25 μm thick structural layer. The composition was baked on a hot plate at 65° C. for 10 minutes, masked and exposed in a Saturn Spectrum III stepper manufactured by Ultratech Stepper Inc., California, baked at 100° C. for 10 minutes, developed with a 1:1 W/W mixture of xylene and methyl-iso-butyl-ketone, and finally baked at 150° C. for 30 minutes.

TABLE 2

| Component | Amount (% by weight) |
|---|---|
| EHPE 3150 | 72.54 |
| Cyracure 6992 | 4.50 |
| Perilene | 0.26 |
| 1,4-HFAB | 15.00 |
| Silquest A187 | 7.50 |
| DC 57 | 0.2 |

The adhesion properties of the structural layer to the polymeric film were tested by placing samples 1 and 2 in a conventional aqueous ink at 65° C. and then observing the samples with an optical microscope after one, and three weeks.

After one week, the results were good for sample 1 only, while sample 2 already showed detachment of the structural layer and seepage of ink. After three weeks, both samples 1 and 2 showed detachment of the structural layer and seepage of ink (sample 2 showing more severe defects than sample 1).

EXAMPLE 2

Three additional samples were prepared by following the above described procedure by using different mixtures of methane and forming gas (a mixture of 95% $N_2$ and 5% $H_2$) as reagent gas and the partial pressure, the RF power, the gas flux rate, and the deposition times summarized in the following Table 3.

TABLE 3

| Sample | Methane/Forming gas Ratio | Pressure (mT) | Power (W) | Flux (sccm) | Time (min) |
|---|---|---|---|---|---|
| 4 (I) | 2:1 | 150 | 100 | 135 | 10 |
| 5 (I) | 1:1 | 150 | 100 | 135 | 10 |
| 6 (I) | 1:2 | 150 | 100 | 135 | 10 |

(I) Invention

The resulting polymeric films had a thickness of about 25 nm. The XPS analysis of the polymeric film layer clearly showed the carbon and nitrogen peaks, while the gold peak was substantially absent.

The adhesion properties of the polymeric film were tested by placing the samples in a conventional aqueous ink at 65° C. for three weeks and then observing the samples with an optical microscope.

The polymeric film of samples 4 to 6 remained well adhered to the substrate without showing any trace of detachment or seepage.

A 25 μm thick structural layer was formed on samples 4 to 6 by using the same radiation curable composition and procedure described in Example 1.

The adhesion properties of the structural layer to the polymeric film were tested by placing samples 4 to 6 in a conventional aqueous ink at 65° C. and then observing the samples with an optical microscope after one, three, and seven weeks.

The results of sample 4 were classified as excellent. After seven weeks, the structural layer remained well adhered to the polymeric film and to the substrate without showing any trace of detachment or seepage.

The results of samples 5 and 6 were classified as good. After three weeks, the structural layer remained well adhered to the polymeric film and to the substrate without showing any trace of detachment or seepage. However, after seven weeks the sample showed some detachments of the structural layer and seepage of ink.

EXAMPLE 3

A commercial photoresist ORDYL SY 314, a tradename for a dry film photoresist manufactured by Tokyo Ohka Kogyo Co., Japan, was laminated on a sample 7, obtained with the same procedure of sample 4 of the invention.

The adhesion properties of the commercial photoresist to the polymeric film were tested by placing sample 7 in a conventional aqueous ink at 65° C. and then observing the sample with an optical microscope after one, three, and seven weeks.

The results of sample 7 were classified as excellent. After seven weeks, the commercial photoresist remained well adhered to the polymeric film and to the substrate without showing any trace of detachment or seepage.

EXAMPLE 4

An additional sample 8 was prepared by following the above described procedure by using a mixtures 2:1 of methane and forming gas (a mixture of 95% $N_2$ and 5% $H_2$) as reagent gas and the partial pressure, the RF power, the gas flux rate, and the deposition times summarized in the following Table 4.

TABLE 4

| Sample | Methane/Forming gas Ratio | Pressure (mT) | Power (W) | Flux (sccm) | Time (min) |
|---|---|---|---|---|---|
| 8 (I) | 2:1 | 150 | 100 | 45 | 10 |

(I) Invention

The resulting polymeric film had a thickness of about 25 nm. The XPS analysis of the polymeric film layer clearly showed the carbon and nitrogen peaks, while the gold peak was substantially absent.

The adhesion properties of the polymeric film were tested by placing the samples in a conventional aqueous ink at 65° C. for three weeks and then observing the sample with an optical microscope. The polymeric film of sample 8 remained well adhered to the substrate without showing any trace of detachment or seepage.

A 25 μm thick structural layer was formed on another portion of sample 8 by using the same radiation curable composition and procedure described in Example 1.

The adhesion properties of the structural layer to the polymeric film were tested by placing sample 8 in a conventional aqueous ink at 65° C. and then observing the samples with an optical microscope after one, three, and seven weeks.

The results of sample 8 were classified as sufficient. After three weeks, the sample showed some detachments of the structural layer and seepage of ink.

EXAMPLE 5

An additional invention sample 9 was prepared by following the same procedure of example 4 of the invention, but, before forming the structural layer, the sample was immersed in a solution of Silquest® A187™ in ethanol (1:8 weight ratio) for 90 minutes, and then dried in an oven at 100° C. for 2 hours.

The adhesion properties of the structural layer to the polymeric film were tested by placing sample 9 in a conventional aqueous ink at 65° C. and then observing the samples with an optical microscope after one and three weeks.

The results of sample 9 were classified as good. After three weeks, the structural layer remained well adhered to the polymeric film and to the substrate without showing, any trace of detachment or seepage. However, after seven weeks the sample showed some detachments of the structural layer and seepage of ink.

EXAMPLE 6

Sample 10 was prepared according to the following procedure.

A silicon substrate 10 comprising the thin film layers 20 to 100 was inserted into a Europlasma Surface Treatment CD400PC System, manufactured by Europlasma NV, Belgium, an apparatus comprising an aluminium chamber containing positive and ground electrodes attached to a Radio Frequency (RF) generator operating at 13.56 MHz.

A gas inlet valve was opened and a mixture 2:1 of methane and forming gas (a mixture of 95% $N_2$ and 5% $H_2$) at a metered rate was introduced into the chamber for a time of from 15 seconds to 3 minutes until to achieve the desired flow rate of 135 sccm and the partial pressures of 150 mT. Once the flow rate and pressure in the chamber were stabilised, a high voltage was applied in the radio frequency range between the ground and the positive electrodes with a power of 100 W and was maintained for a period of time of about 10 minutes.

Sample 11 was prepared with the same procedure of sample 10, but the radio frequency power and the introduction of forming gas was turn off after 3 minutes. After 2 minutes, the introduction of methane is increased to 270 sccm and, after a stabilization of 30 seconds, the radio frequency power was still applied with a power of 50 W and was maintained for a period of time of about 16 minutes.

Sample 12 was prepared with the same procedure of sample 11, but at the end the sample is further subjected to a radio frequency treatment with a power of 100 W for 1 minute under an oxygen flux of 45 scan.

The adhesion properties of the polymeric film were tested by placing the samples in a conventional aqueous ink at 65° C. for three weeks and then observing the samples with an optical microscope.

The polymeric film of samples 10 to 12 remained well adhered to the substrate without showing any trace of detachment or seepage.

A liquid photoresist TMMR S2000 was spun coated on samples 10 to 12 by means of a OPTIspin ST20 spinner manufactured by SSE Sister Semiconductor Equipment Gmbh at 2,000 rpm for 15 seconds to provide a 2 μm thick planarizing layer. The composition was baked on a hot plate at 65° C. for 10 minutes, masked and exposed in a Saturn Spectrum III stepper manufactured by Ultratech Stepper Inc., California, baked at 100° C. for 10 minutes, developed with a 1:1 W/W mixture of xylene and methyl-iso-butyl-ketone, and finally baked at 150° C. for 30 minutes.

The planarizing layer obtained on sample 10 did not cure in uniform way and was partially removed due to the presence on the interface with the polymeric film of amine groups which inhibited the curing reaction of the curable composition.

The planarizing layer obtained on sample 11 showed better curing, but the absence on the interface with the polymeric film of polar groups made difficult to coat the curable composition due to the poor wettability of such an interface.

The planarizing layer obtained on sample 12 showed the best characteristics both in terms of curing reaction (for the absence of amino groups) and surface wettability (for the presence of hydroxy groups). At the same time, good adhesion properties of the planarizing layer to the polymeric film were obtained.

The adhesion properties of the planarizing layer to the polymeric film were tested as described above by placing sample 12 in a conventional aqueous, ink at 65° C. and then observing the samples with an optical microscope after one, and three weeks. The results of sample 12 were classified as excellent. After seven weeks, the planarizing layer remained well adhered to the polymeric film and to the substrate without showing any trace of detachment or seepage.

EXAMPLE 7

A commercial photoresist Ordyl SY 314 was laminated on a silicon substrate 10 comprising the thin film layers 20 to 100. The photoresist was then masked, exposed to a collimated ultraviolet light source, baked after exposure and developed to define the ink passage ways by removing unneeded material.

A set of conventional nozzle plates made of nickel coated with a layer of gold on the surface intended to face the photoresist was adhered to the photoresist using standard techniques. The resulting printheads were used to manufacture conventional ink-jet printing heads 1 comprising an ink tank.

A second set of conventional nozzle plates was plasma treated into the Europlasma Surface Treatment CD400PC System described above with a mixture 2:1 of methane and forming gas (a mixture of 0.95% $N_2$ and 5% $H_2$) at a flow rate of 135 sccm and a partial pressure of 150 mT by applying a radio frequency power of 100 W for a period of time of about 10 minutes. The external surface of the nozzle plate was masked with an adhesive tape to limit the formation of the plasma deposited polymeric film on the internal surface intended to face the photoresist. The resulting plasma treated internal surface of the nozzle plate was adhered to the photoresist using standard techniques. The resulting printheads were used to manufacture ink-jet printing heads 2 comprising an ink tank.

A printing test was made after storage of the ink-jet printing heads in an oven at 65° C. for three weeks. The printing dialects of the inkjet printing heads 2 comprising the plasma treated nozzle plates were far below the printing defects of the ink-jet printing heads 1 comprising the conventional nozzle plates. Further, the torn test made to separate the nozzle plate from the photoresist showed substantially no trace of photoresist adhered to the nozzle plate in the case of the conventional nozzle plate, clearly indicating that the bonding force was weak. On the contrary, the same torn test showed a lot of residuals of photoresist adhered to the nozzle plate in the case of the plasma treated nozzle plate, clearly indicating that the bonding force was strong.

List of Chemicals

EHPE 3150 is a tradename of Daicel Chemical Industries, Ltd. for a multifunctional epoxy resin having formula:

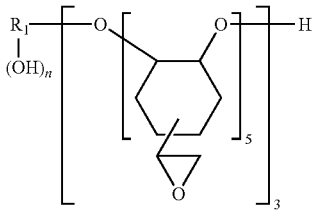

Cyracurem™ 6992 is a tradename of a triarylsulfonium exafluoro-antimonate available from Dow Chemical, Midland, Mich., USA.

Perilene is a chemical sensitizer having formula:

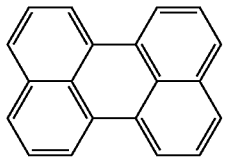

1,4-HFAB is a tradename of Central Glass Co, Ltd., Japan for a fluorinated diol having formula:

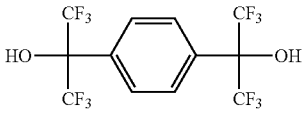

Silquest® A187™ is a trademark of Crompton. Corporation for an epoxy alkoxy silane having the following formula:

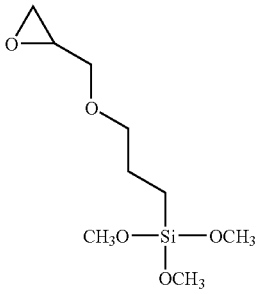

DC 57 is a tradename of a polysiloxane additive available from Dow Chemical, Midland, Mich., USA.

ORDYL SY 314 is a tradename for a dry film photoresist manufactured by Tokyo Ohka Kogyo Co., Japan.

TMMR S2000 is a tradename for a curable liquid epoxy resin manufactured by Tokyo Ohka Kogyo Co., Japan.

The invention claimed is:

1. An ink-jet print head comprising a substrate comprising a plurality of thin film layers and a layer defining ink passage ways formed thereon, wherein said plurality of thin film layers comprises a metal layer facing said layer defining ink passage ways, characterized in that a layer of polymeric material comprising carbon, hydrogen, and nitrogen atoms is interposed between said metal layer and said layer defining ink passage ways, and in that said layer of polymeric material comprises from 10 to 50% by weight of nitrogen atoms.

2. The ink jet print head according to claim 1, wherein said metal layer comprises gold.

3. The ink jet print head according to claim 1, wherein said metal layer is a patterned gold layer.

4. The ink jet print head according to claim 1, wherein said layer of polymeric material covers the whole surface of said substrate comprising a plurality of thin film layers.

5. The ink jet print head according to claim 1, wherein said layer defining ink passage ways is a structural layer comprising a plurality of nozzles.

6. The ink jet print head according to claim 1, wherein said layer defining ink passage ways is a barrier layer.

7. The ink-jet print head according to claim 6, wherein said ink-jet print head further comprises a nozzle plate disposed on said barrier layer and comprising a metal layer facing said barrier layer, characterized in that a further layer of polymeric material comprising carbon, hydrogen, and nitrogen atoms is interposed between said metal layer and said barrier layer.

8. The inkjet print head according to claim 7, wherein said metal layer comprises gold.

9. The ink jet print head according to claim 1, wherein said layer of polymeric material has a thickness of from 1 to 400 nm.

10. The ink jet print head according to claim 1, wherein said layer of polymeric material comprises from 25 to 75% by weight of carbon atoms.

11. The ink jet print head according to claim 1, wherein said layer of polymeric material comprises from 20 to 40% of nitrogen atoms.

12. The ink jet print head according to claim 1, wherein said layer of polymeric material comprises at least one monolayer of an adhesion promoting agent.

13. The ink-jet print head of claim 12, wherein said adhesion promoting agent is selected from the group consisting of epoxy alkoxy silanes, amino alkoxy silanes, vinyl alkoxy silanes, isocyanato alkoxy silanes, mercapto-silanes and amino-silanes.

14. The ink-jet print head of claim 12, wherein said adhesion promoting agent is selected from the group consisting of γ-glycidoxypropyltrimethoxy silane, γ-aminopropyltrimethoxy silane, γ-isocyanatopropyltrimethoxy silane, N-β-(aminoethyl)-γ-aminopropyltrimethoxy silane, N-(2-aminoethyl)-3-amino-propylmethyldimethoxy silane, 3-aminopropylmethyldimethoxy silane, bis-(γ-trimethoxysilylpropylamine), N-phenyl-γ-aminopropyltrimethoxy silane, γ-iso-cyanatopropylmethyldimethoxy silane, γ-isocyanatopropyltriethoxy silane, γ-(3,4-epoxycyclohexyl)ethyltriethoxy silane, γ-glycidoxypropylmethyldimethoxy silane, tris(γ-trimethoxy-silylpropyl) isocyanurate, 2-(diphenylphosphino)-ethyl-triethoxy silane, trimethylsilyl acetamide, bis[3-(triethoxysilyl)propyl]-tetra-sulphide, 3-mercaptopropyl triethoxy silane, vinyltriethoxy silane, and vinyltrimethoxy silane.

15. The ink jet print head according to claim 1, wherein said layer of polymeric material has a thickness of from 5 to 200 nm.

16. The ink jet print head according to claim 1, wherein said layer of polymeric material comprises from 35 to 65% by weight of carbon atoms.

17. An ink jet print head comprising a substrate comprising a plurality of thin film layers, a barrier layer formed thereon, and a nozzle plate disposed on said barrier layer, wherein said nozzle plate comprises a metal layer facing said barrier layer, characterized in that a layer of polymeric material comprising carbon, hydrogen, and nitrogen atoms is interposed between said metal layer and said barrier layer.

18. The ink jet print head according to claim 17, wherein said metal layer comprises gold.

19. A process of manufacturing an ink-jet print head comprising the steps of:

providing a substrate, forming a layer of polymeric material comprising carbon, hydrogen, and nitrogen atoms on said substrate, and forming a layer defining ink passage ways on said polymeric material layer, wherein said step of forming a layer of polymeric material is made by plasma polymerization treatment of a surface of said substrate with a mixture of methane and forming gas, wherein said mixture of methane and forming gas has a methane to forming gas weight ratio of from 1:5 to 5:1.

20. The process according to claim 19, wherein said forming gas comprises a mixture of nitrogen and hydrogen gas, the amount of said hydrogen within said forming gas being lower than 10% by weight with respect the total mixture.

21. The process according to claim 19, wherein said plasma polymerization treatment is conducted using a flow rate of said mixture of gases ranging from 1 to 300 sccm.

22. The process according to claim 19, wherein said plasma polymerization treatment is conducted using a power ranging from 10 to 400 Watt.

23. The process according to claim 19, wherein said plasma polymerization treatment is conducted for a period of time ranging from 15 seconds to 100 minutes.

24. The process according to claim 19, wherein said plasma polymerization treatment is conducted using a flow rate of said mixture of gases ranging from 10 to 200 sccm.

25. The process according to claim 19, wherein said plasma polymerization treatment is conducted using a power ranging from 20 to 200 Watt.

26. The process according to claim 19, wherein said plasma polymerization treatment is conducted for a period of time ranging from 1 minute to 60 minutes.

27. A process of manufacturing an ink jet print head comprising the steps of:

providing a substrate, forming a layer defining ink passage ways on said substrate, providing a nozzle plate, forming a layer of polymeric material comprising carbon, hydrogen, and nitrogen atoms on a surface of said nozzle plate, and adhering said surface of said nozzle plate bearing said layer of polymeric material comprising carbon, hydrogen, and nitrogen atoms to said layer defining ink passage ways, wherein said step of forming a layer of polymeric material is made by plasma polymerization treatment of said surface of said nozzle plate with a mixture of gases comprising carbon, hydrogen and nitrogen atoms.

28. The process according to claim 27, wherein said plasma polymerization treatment is made by using a mixture of gases selected from the group comprising saturated and unsaturated hydrocarbons, nitrogen-containing hydrocarbons, nitrogen, ammonia, carbon dioxide and hydrogen.

29. The process according to claim 27, wherein said plasma polymerization treatment is made by using a mixture of methane and forming gas.

30. The process according to claim 27, wherein said mixture of methane and forming gas has a methane to forming gas weight ratio of from 1:5 to 5:1.

31. The process according to claim 27, wherein said forming gas comprises a mixture of nitrogen and hydrogen gas, the amount of said hydrogen within said forming gas being lower than 10% by weight with respect the total mixture.

32. The process according to claim 27, wherein said plasma polymerization treatment is conducted using a flow rate of said mixture of gases ranging from 1 to 300 sccm.

33. The process according to claim 27, wherein said plasma polymerization treatment is conducted using a power ranging from 10 to 400 Watt.

34. The process according to claim 27, wherein said plasma polymerization treatment is conducted for a period of time ranging from 15 seconds to 100 minutes.

35. The process according to claim 27, wherein said plasma polymerization treatment is conducted using a flow rate of said mixture of gases ranging from 10 to 200 sccm.

36. The process according to claim 27, wherein said plasma polymerization treatment is conducted using a power ranging from 20 to 200 Watt.

37. The process according to claim 27, wherein said plasma polymerization treatment is conducted for a period of time ranging from 1 minute to 60 minutes.

* * * * *